United States Patent [19]

Omori

[11] Patent Number: 4,651,530

[45] Date of Patent: Mar. 24, 1987

[54] METHOD AND APPARATUS FOR FEED-WATER CONTROL IN A STEAM GENERATING PLANT

[75] Inventor: Takashi Omori, Kitaibaraki, Japan

[73] Assignee: Hitachi, Ltd., Tokyo, Japan

[21] Appl. No.: 362,157

[22] Filed: Mar. 26, 1982

[30] Foreign Application Priority Data

Mar. 27, 1981 [JP] Japan ..... 56-43966

[51] Int. Cl.[4] ..... F22D 5/28; F22D 5/30; G21D 1/04

[52] U.S. Cl. ..... 60/667; 60/644.1; 60/646; 122/406 ST; 376/246; 376/247; 376/370; 376/402

[58] Field of Search ..... 376/207, 210, 215, 216, 376/245, 246, 247, 282, 298, 299, 361, 366, 370, 402; 60/644.1, 646, 656, 665, 667; 122/406 ST

[56] References Cited

U.S. PATENT DOCUMENTS

| | | | |
|---|---|---|---|
| 3,284,312 | 11/1966 | West | 376/299 |
| 3,384,550 | 5/1968 | Hanzalek | 376/298 |
| 3,431,168 | 3/1969 | Kjemtrup | 376/299 |
| 4,046,628 | 9/1977 | Middleton | 376/282 |
| 4,290,850 | 9/1981 | Omori et al. | 376/210 |
| 4,322,267 | 3/1982 | Kinoshita et al. | 376/216 |
| 4,440,715 | 4/1984 | Sato et al. | 376/210 |

FOREIGN PATENT DOCUMENTS

| | | |
|---|---|---|
| 53-93202 | 8/1978 | Japan . |
| 1020923 | 2/1966 | United Kingdom . |

*Primary Examiner*—Charles T. Jordan
*Assistant Examiner*—Richard Klein
*Attorney, Agent, or Firm*—Antonelli, Terry & Wands

[57] ABSTRACT

A method and an apparatus for feed-water control in a steam generating plant such as a boiling water nuclear reactor having motor-driven feed-water pumps and turbine-driven feed-water pumps for supplying feed-water to a steam generator, in which the feed-water flow through the turbine-driven feed-water pumps is controlled to be maintained constant, while reducing the recirculation flow discharged from the turbine-driven feed-water pumps and fed back to the inlet thereof, so as to reduce the amount of feed-water supplied to the steam generator by the motor-driven feed-water pumps, whereby variation of water level in the steam generator during switching between the two kinds of feed-water pumps is suppressed.

12 Claims, 7 Drawing Figures

METHOD AND APPARATUS FOR FEED-WATER CONTROL IN A STEAM GENERATING PLANT

The present invention relates to a method and an apparatus for feed-water control in a steam generating plant, and particularly to a method and an apparatus for feed-water control in a steam generating plant suitable for switching between turbine-driven feed-water pumps (hereinafter termed T-RFP's) and motor-driven feed-water pumps (hereinafter termed M-RFP's) used in a boiling water nuclear reactor which is a kind of a steam generator.

The boiling water reactor has a pressure vessel containing a reactor core loaded with numerous fuel assemblies. Since the pressure vessel of the boiling water reactor generates steam internally, it is categorized as a steam generator. The feed-water, i.e. the cooling water, supplied into the pressure vessel is heated by the nuclear fission of the fuel as it is fed through the core, and it turns into steam. Steam exhausted from the pressure vessel is conducted to a turbine so that it drives the turbine. The exhaust steam from the turbine is condensed by a condenser and restored to water. This water is pressurized by a feed-water pump and supplied back into the pressure vessel as the feed-water. For the feed-water pump, there are provided two T-RFP's in the normal operation of the reactor and two M-RFP's used in starting and halting the reactor and kept in a stand-by state in the normal operation of the reactor so that they serve as back-up pumps for the T-RFP's. The T-RFP's have a larger capacity than that of the M-RFP's.

Feed-water flow control generally employs three-factor control as disclosed in U.S. Pat. No. 4,290,850, entitled, "Method and Apparatus for Controlling Feed-water Flow to Steam Generating Device". The three-factor control is a method of controlling the rotational speed of the T-RFP's or the opening of the flow control valve which regulates the feed-water flow from the M-RFP basing on three factors: the water level in the reactor (steam generator), the feed-water flow and the steam flow.

In starting the reactor, the feed-water flow needs to be increased as the power output increases. This is carried out by initially activating the M-RFP's and, after that, switching the pumps from the M-RFP's to the T-RFP's. When the amount of feed-water flow is small, a recirculation valve provided on the return pipe is opened so that at least part of the feed-water from the M-RFP's and T-RFP's is returned to the condenser, thereby providing a minimum water flow for the pumps.

It is therefore an object of the present invention to suppress the water level variation in the steam generator during the switching of the feed-water pumps.

Another object of the present invention is to allow a high response suppression against the water level variation in the steam generator during the switching of the feed-water pumps.

Still another object of the present invention is to provide a feed-water control apparatus having a simple structure.

According to one aspect of the present invention, the feed-water flow through a second feed-water means is controlled to maintain a constant flow and the circulation flow of the feed-water discharged from the second feed-water means and fed back to the inlet of the second feed water means is reduced, whereby to reduce the feed-water flow supplied to the steam generator by a first feed-water means with separate driving means from that of the second feed-water means.

Figure 1:
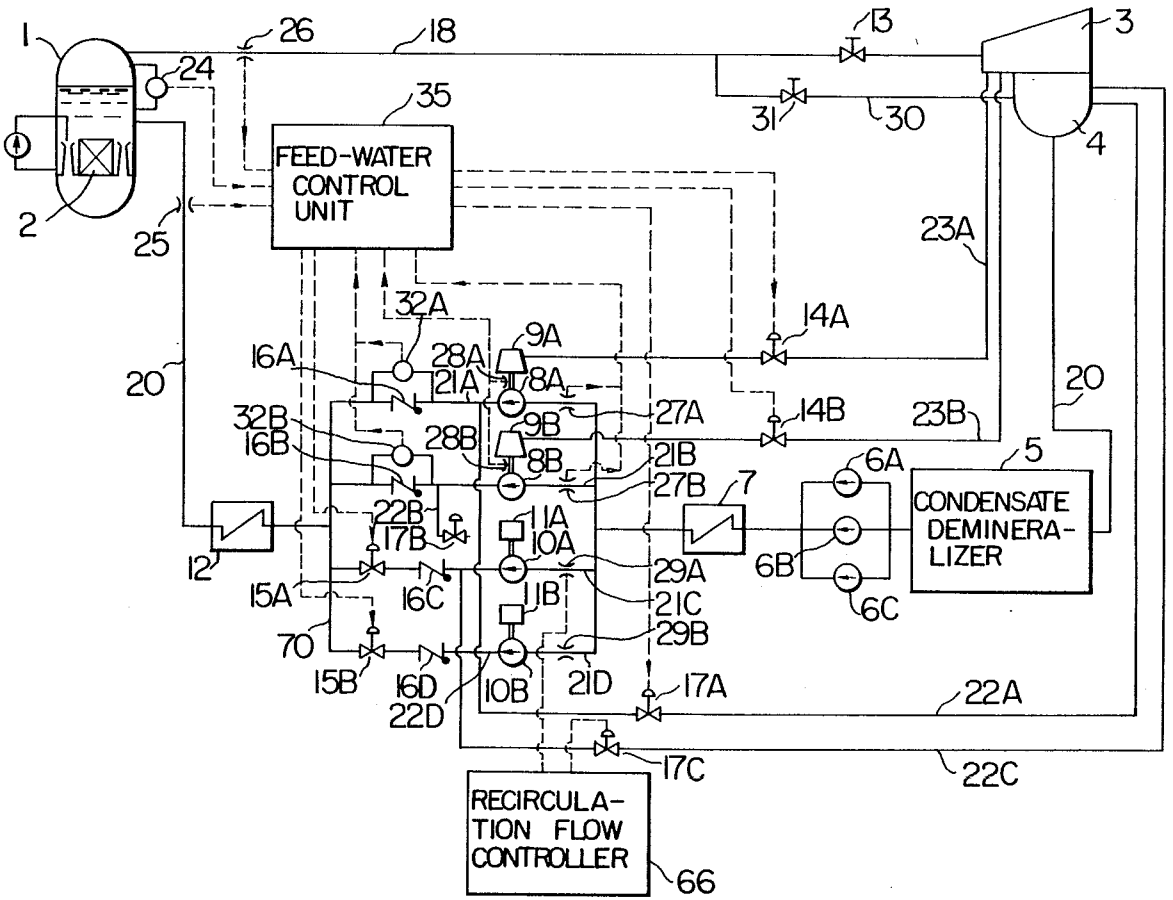
FIG. 1 is a systematic diagram of the feedwater control system for a steam generating plant embodying the present invention applied to the boiling water nuclear reactor.

It has been practiced in the boiling water nuclear reactor in switching feed-water pumps (from M-RFP's to T-RFP's), connecting feed-water pumps in parallel (starting of the second T-RFP) and disconnecting a feed-water pump (disconnection of one of two T-RFP's for a lower power output) that, the above-mentioned recirculation valve on the return pipe is opened in advance and the switching operation is carried out manually. The recirculation valve is opened or closed in two-state operation depending on the amount of feed-water flow through the feed-water pumps. In such conventional operation, if the minimum flow of the feed-water pumps is about 10% of the pump capacity, the ON/OFF control of the recirculation valve when the pumps have been switched does not significantly affect the amount of the feed-water flow. That is, if the minimum flow is less than 10% of the pump capacity, this conventional operation causes no problem in operating the reactor.

However, protection of the feed-water pumps is further requested for enhancement of safety, and it is necessary to increase the flow in the feed-water pumps to at least 20–30% of the capacity. In the above-mentioned ON/OFF control for the recirculation valve, the amount of flow to which the valve is to be closed must be set approximately twice as large as that to which the valve is to be opened for preventing a chatter in the valve. This gives rise to a large variation of the feed-water flow at opening or closing the recirculation valve during a rise or fall of the reactor output power, resulting in a significant effect on the water level in the reactor.

The present invention contemplates to solve the foregoing deficiency in the prior art technology, and according to the invention the recirculation valve is controlled continuously in switching the feed-water pumps so that the amount of feed-water flow through the T-RFP's and M-RFP's is maintained constant, whereby to prevent the variation of the water level in the steam generator when switching the pumps.

The feed-water control system embodying the present invention applied to the boiling water nuclear reactor which is a kind of the steam generator will now be described with reference to FIGS. 1, 2 and 3.

In the normal operation of the boiling water nuclear reactor, the cooling water (feed-water) is heated by the core 2 in the presssure vessel (steam generator) 1 and turns into steam. This steam is taken out of the pressure vessel 1 and delivered to the turbine 3 through the main steam pipe 18 having a main steam valve 13. Steam exhausted from the turbine 3 is condensed by the condenser 4 and turns into water. Condensed water taken out of the condenser 4, i.e., which will become the cooling water for the reactor, is conducted through the feed-water pipe 20 to the condensate demineralizer 5. The feed-water cleaned by the condensate demineralizer 5 is pressurized by the condensate pumps 6A and 6B, then conducted to the low-pressure feed-water heater 7. The condensate pump 6C is a back-up pump, and it is in a stand-by state while the reactor is operated normally. The feed-water heated by the low-pressure feed-water heater 7 is pressurized by two T-RFP's 8A and 8B located on the branch pipes 21A and 21B, respectively, of the feed-water pipe 20, then further heated by the high-pressure feed-water heater 12. The feed-water taken out of the high-pressure feed-water heater 12 is conducted through the feed-water pipe 20 and supplied to the reactor pressure vessel 1. Although it is not shown in the figure, the low-pressure and high-pressure feed-water heaters 7 and 12 are supplied with steam extracted from the turbine 3 as a feed-water heat source. The extracted steam is condensed inside each feed-water heater and then conducted to the condenser 4 as the drainage.

The T-RFP's 8A and 8B are driven by being supplied with the extracted steam from the turbine 3 through the extraction steam pipe 23A and 23B. Although it is not shown in the figure, the extraction steam is exhausted into the low-pressure feed-water heater 7. The rotational speed of the T-RFP's 8A and 8B is controlled by adjusting the extraction steam flow by means of the turbine control valves 14A and 14B provided on the extraction steam pipes 23A and 23B, respectively. The M-RFP's 10A and 10B provided on the branch pipes 21C and 21D of the feed-water pipe 20 are in a stand-by state as back-up pumps for the T-RFP's during a normal operation of the reactor. The M-RFP 10A is activated when the reactor is started or halted. The M-RFP 10B is also used as a back-up pump for the M-RFP 10A. The amount of feed-water pumped by the T-RFP's 8A and 8B is adjusted by speed control of the T-RFP's 8A and 8B by means of the turbine control valves 14A and 14B, respectively. The amount of feed-water pumped by the M-RFP's 10A and 10B is controlled by means of the flow control valves 15A and 15B provided on the branch pipes 21C and 21D, respectively. Feed-water flow control by use of the turbine control valves 14A and 14B and the flow control valves 15A and 15B is carried out by the feed-water control unit 35 which receives measurement values from the water level meter 24 which measures the water level in the pressure vessel 1, the feed-water flow meter 25 and the main steam flow meter 26.

Figure 2:
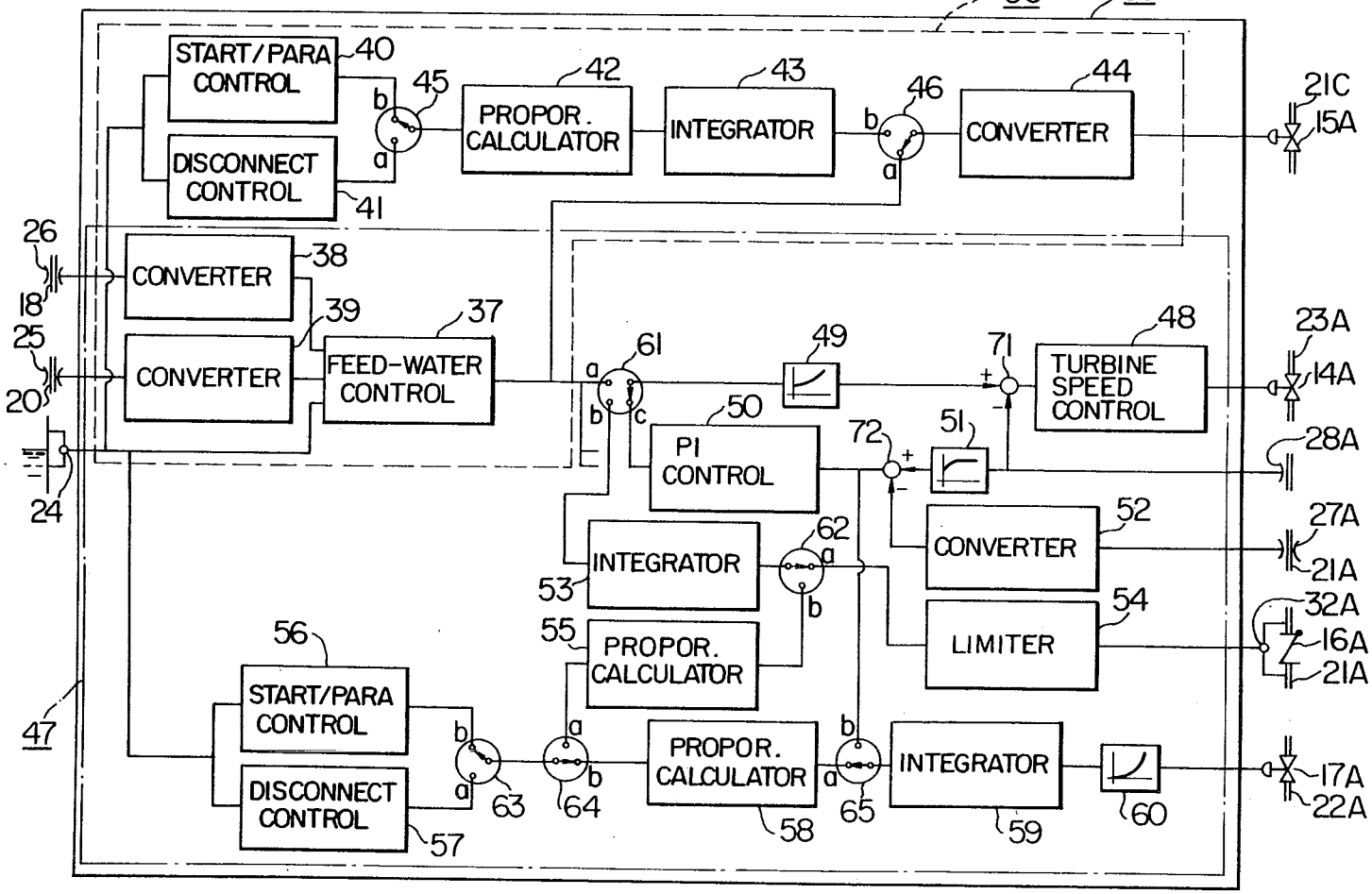
FIG. 2 is a detailed systematic diagram of the feed-water control system shown in FIG. 1.

The feed-water control unit 35 includes an M-RFP control unit 36 and a T-RFP control unit 47 as shown in FIG. 2. The control units 36 and 47 shown in FIG. 2 are used to control the T-RFP 8A and M-RFP 10A, and there are also provided identical control units for controlling the T-RFP 8B and M-RFP 10B. Both the M-RFP and T-RFP control units 36 and 47 incorporate a feedwater controller 37 and signal converters 38 and 39. The feed-water controller 37 is made up of two operational amplifiers, switches and a PI calculator, as disclosed in FIG. 2 of U.S. Pat. No. 4,290,850. The signal converters 38 and 39 are each made up of a square root extractor and an adder, as disclosed in FIG. 2 of the same patent.

The M-RFP control unit 36 further includes a starting and parallel connecting ON/OFF controller 40, a disconnecting ON/OFF controller 41, a proportional calculator 42, an integrator 43, an E/P converter 44, and switches 45 and 46. The T-RFP control unit 47 further includes a turbine speed controller 48, function generators 49, 51 and 60, a PI controller 50, a flow signal converter 52, integrators 53 and 59, a limiter 54, proportional calculators 55 and 58, a starting and parallel connecting ON/OFF controller 56, a disconnecting controller 57, and switches 61, 62, 63, 64 and 65. The PI controller 50 and function generator 51 are control means for maintaining a constant flow of feed-water through the T-RFP 8A, while the integrator 53 and limiter 54 are means for providing equalizing control for the T-RFP 8A. The integrator 59 and function generator 60 are means for controlling the recirculation flow. FIG. 3 shows the recirculation flow controller for the M-RFP 10A. The recirculation flow controller 66 includes a signal converter 67, a PI controller 68 and a function generator 69.

The operational function of the feed-water control unit 35 will now be described with reference to FIGS. 1, 2 and 3 by way of example where the power output of the boiling water nuclear reactor is increased from 0% to 100%.

In starting the boiling water nuclear reactor, the control rods (not shown in the figure) which have been inserted in the reactor core 2 are drawn out so that the temperature and pressure in the reactor pressure vessel 1 will rise. When the temperature and pressure have reached each predetermined point, the by-pass valve 31 is opened with the main steam valve 13 kept closed. Steam generated in the pressure vessel 1 is conducted through the main steam pipe 18 and by-pass pipe 30 to the condenser 4, where it is condensed into water. This gives rise to a fall in the water level in the pressure vessel 1, and it is necessary to feed water into the pressure vessel 1. The single M-RFP 10A which is driven by the motor 11A is activated so that water condensed in the condenser 4 is conducted into the pressure vessel 1. The M-RFP 10B which is driven by the motor 11B stays in a stand-by state as a backup pump.

As the reactor power output rises, the feed-water flow increases, which is controlled by the feed-water controller 37. The feed-water controller 37 receives the output signal of the water level meter 24 and the output signals from the main steam flow meter 26 and feed-water flow meter 25 via the signal converters 38 and 39, respectively, and regulates the opening of the flow regulating valve 15A in accordance with these signals. Thus, the cooling water level in the pressure vessel 1 is maintained constant.

While the M-RFP 10A is activated, each of the switches has the state of connection as follows. The switches 46 and 65 select their contact a, while the switches 61, 62, 63 and 64 select their contact b.

When the feed-water flow reaches the feed capacity of the M-RFP 10A, it is switched to the T-RFP 8A in the following switching procedures. The T-RFP 8A starting operation includes the T-RFP acceleration control mode (1), the pressure equalization control mode (2) which brings the discharge pressure of the T-RFP to the pressure of the feed-water pump discharge header 70 (which connects the outlets of the branch pipes 21A, 21B and 21C, and is connected with the feed-water pipe 20), and the flow switching control mode (3) which switches control from the M-RFP 10A to T-RFP 8A.

The main steam valve 13 opens and the bypass valve 31 is closed, then steam generated in the pressure vessel 1 is delivered to the turbine 3. After that, the acceleration control for the T-RFP 8A is carried out. First, the turbine speed controller 48 is operated manually, and the turbine control valve 14A provided on the extraction steam pipe 23A opens gradually in response to the output signal from the turbine speed controller 48. Steam extracted from the turbine 3 is fed through the extraction pipe 23A to the turbine 9A whereby to drive the T-RFP 8A coupled to the turbine 9A. The operation in the acceleration control mode (1) completes when the rotational speed of the T-RFP 9 A has reached 40–50% of the rated speed. During the acceleration control mode (1), the switch 65 selects contact b. Other switches maintain the states of connection as described previously. The recirculation valve 17A provided on the recirculation pipe 22A which connects the branch pipe 21A on the discharge port of the T-RFP 8A to the condenser 4 opens in response to the output signal from the tachometer 28A which detects the rotational speed of the T-RFP 8A. When the recirculation valve 17A has opened, the feed-water discharged from the T-RFP 8A is fed back through the recirculation pipe 22A to the condenser 4. Thus, the feed-water discharged from the T-RFP 8A circulates in a closed loop constituted by the feed-water pipe 20 and the recirculation pipe 22A. Recirculation pipes 22B, 22C and 22D connected to the condenser 4 are connected to branch pipes 21B, 21C and 21D on the discharge port side of the T-RFP 8B, M-RFP 10A and M-RFP 10B, respectively. The T-RFP 8B is provided with a tachometer 28B.

Figure 4:
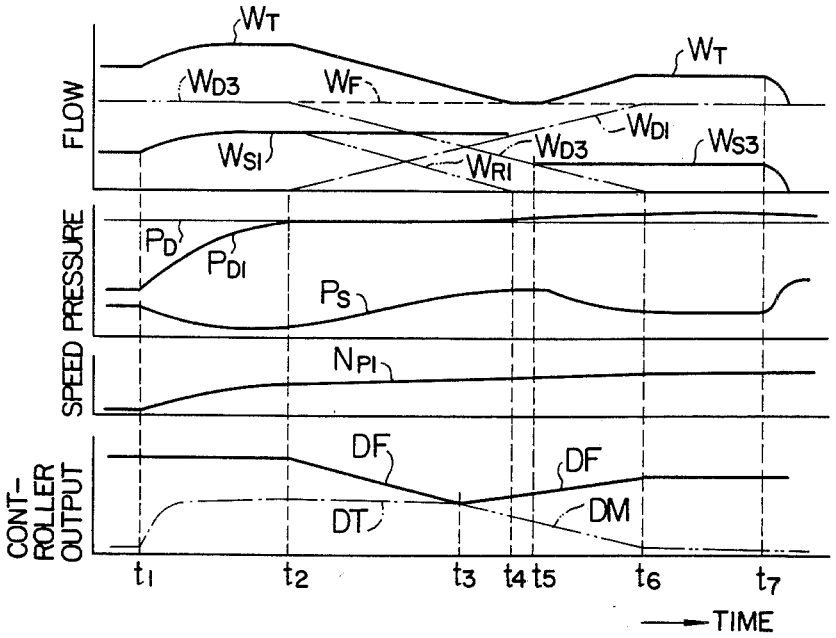
FIG. 4 is an explanatory diagram showing the control characteristics of the embodiment shown in FIG. 1 during the starting operation of the feed-water pumps.

After the operation in the acceleration control mode (1) has completed, the operation in the pressure equalization control mode (2) is started at time t1 shown in FIG. 4. Variation of the feed-water flow is shown in FIG. 4. During the pressure equalization control mode (2), the switches in the feed-water control unit 35 are connected as follows. The switches 46 and 62 select contact a, while the switches 61, 63, 64 and 65 select contact b. The differential pressure at the front and back of the check valve 16A provided on the branch pipe 21A is measured by the differential pressure sensor 32A. The pressure in the branch pipe 21A on the upstream side of the check valve 16A is equal to the discharge pressure $P_{D1}$ of the T-RFP 8A. The pressure in the branch pipe 21A on the downstream side of the check valve 16A is equal to the discharge pressure $P_D$ of the M-RFP 10A. When the discharge pressure $P_{D1}$ becomes equal to the discharge pressure $P_D$, the pressure equalization control mode completes. At time t1, the discharge pressure $P_{D1}$ is lower than $P_D$, and the check valve 16A is kept closed. The output signal from the differential pressure sensor 32A is sent via the limiter 54, switch 12, integrator 53 and switch 61 to the function generator 49. The function generator 49 performs nonlinear compensation for the TRFP 8A. The turbine speed controller 48 increases the opening of the turbine control valve 14A in accordance with the output signal from the function generator 49. Consequently, the rotational speed $NP_1$ of the T-RFP 8A and its discharge pressure $P_{D1}$ increase. The speed demand signal DT for the T-RFP 8A which is the output of the integrator 53 rises sharply at time t1 in response to the output signal from the differential pressure sensor 32A indicating the differential pressure between the discharge pressures $P_D$ and $P_{D1}$ as shown in FIG. 4. After that the speed demand signal DT turns to a dull rise and then reaches a constant level. The rotational speed $NP_1$ of the T-RFP 8A also increases in response to the rise of the speed demand signal DT. FIG. 4 also shows the variation of the suction pressure $P_S$ of the T-RFP 8A. The output signal from the tachometer 28A is negatively added as a feedback signal to the output signal of the function generator 49 by the adder 71, while being supplied to the function generator 51 which produces the minimum flow for the pump relative to the turbine speed represented by the output signal of the tachmeter 28A. The amount of feed-water flow fed through the T-RFP 8A (will be termed pumped flow) is measured by the flow meter 27A provided on the branch pipe 21A on the upstream side of the T-RFP 8A. The output signal of the flow meter 27A is sent via the flow signal converter 52 and negatively added as a feedback signal to the output signal of the function generator 51 by the adder 72. The output signal of the adder 72 is sent via the switch 65, integrator 59, and function generator 60 which compensates the nonlinearity of the recirculation valve 17A, and used to regulate the opening of the recirculation valve 17A. In the pressure equalization control mode (2), the pumped flow $W_{S1}$ of the T-RFP 8A is controlled to maintain the minimum pumping flow which depends on the rotational speed $NP_1$, and it increases in proportion to an increase in the rotational speed $NP_1$. Thus, as the pumped flow $W_{S1}$ increases, the opening of the recirculation valve 17A also increases. In the pressure equalization control mode (2), the whole pumped flow $W_{S1}$ is returned to the condenser 4 as the recirculation flow $W_{R1}$ through the recirculation pipe 22A.

The feed-water flow $W_F$ supplied to the pressure vessel 1 is constant and equal to the discharge flow $W_{D3}$ of the M-RFP 10A. The total pumped flow $W_T$ through the M-RFP 10A and T-RFP 8A equals $W_F+W_{S1}$, which varies depending on the pumped flow $W_{S1}$ There is provided a check valve 16B on the branch pipe 21B on the downstream side of the T-RFP 8B; also provided is a flow meter 28B on the upstream side thereof. While the T-RFP 8B is activated, the differential pressure between the front and back of the check valve 16B measured by the differential pressure sensor 32B and the output of the flow meter 27B are delivered to the feed-water control unit 35.

At time t2, the discharge pressure $P_{D1}$ becomes equal to $P_D$ and the operation in the pressure equalization control mode (2) for the T-RFP 8A and M-RFP 10A completes. Next, control proceeds to the switching control mode (3). The switching control mode (3) is divided into a switching control mode (I) in opening the recirculation valve and a switching control mode (II) when the recirculation valve is closed completely. At time t2, connection of the switches is altered so that the operation in the switching control mode (I) is carried out. From the states in the pressure equalization control mode (2), the switch 61 turns to select contact c and the switch 65 selects contact a. The output signal of the function generator 51 sent via the adder 72 to the PI controller 50. Although it is not shown in the figure, the PI controller 50 is capable of bumpless switching following the output signal of the integrator 53 in the state immediately before the switching has been made. Accordingly, the speed demand signal DT produced by the PI controller 50 basing on the output signal of the function generator 51 is continuous with the speed demand signal DT produced by the integrator 53. The speed demand signal DT from the PI controller 50 is sent via the function generator 49 and adder 71 to the turbine speed controller 48, which controls the turbine control valve 14A to maintain a constant pumped flow $W_{S1}$. Thus, the pumped flow through the T-RFP 8A is maintained constant.

The output signal of the water level meter 20 is delivered to the function generator 60 via the starting and parrallel connecting ON/OFF controller 56, switches 63 and 64, proportional calculator 58, switch 65, and integrator 59. The opening of the recirculation valve 17A decreases in response to the output signal of the function generator 60. As the opening of the recirculation valve 17A decreases, the recirculation flow $W_{R1}$ decreases and the feed-water flow $W_{D1}$ (hereinafter called reactor supply flow) discharged from the T-RFP 8A and conducted through the check valve 16A to the pressure vessel 1 increases gradually. Since the recirculation valve 17A needs to be closed for the demand of increasing the flow $W_{D1}$ through the check valve 16A, the proportional calculator 58 reverses the polarity, of the output signal of the starting and parallel connecting ON/OFF controller 56. An increase in the reactor supply flow $W_{D1}$ causes a rise in the water level in the pressure vessel 1, which is sensed by the level meter 20 and indicated to the feed-water controller 37. The feed-water controller 37 issues a signal to the electric-pressure converter 44 so that the feed-water flow supplied to the pressure vessel 1 is reduced, and the opening of the flow regulating valve 15A is decreased. Then, the feed-water flow discharged from the M-RFP 10A and conducted to the pressure vessel 1 (i.e. reactor supply flow), $W_{D3}$, decreases. During the operation in the switching control mode (I), the recirculation valve 10C does not open, and therefore, if the water level in the pressure vessel 1 exceeds the stated level, the starting and parallel connecting ON/OFF controller 56 operates to suspend the switching control mode (I). While the operation in the switching control mode (I) proceeds, the pumped flow $W_{S1}$ stays virtually constant. However, the reactor supply flow $W_{D3}$ produced by the M-RFP 10A decreases. In this case, the pumped flow $W_{S3}$ through the M-RFP 10A is equal to the reactor supply flow $W_{D3}$. Accordingly, the total pumped flow $W_T$ decreases. The output signal DF from the feed-water controller 37 also decreases so as to suppress the rising water level.

At time t3, the output signal DF becomes equal to the speed demand signal DT which is the output of the PI controller 50. Then, the switch 46 selects contact b and the switches 45 and 61 select contact a. Consequently, at time t3, the feed-water controller 37 which carries out control basing on the water level, feed-water flow and steam flow of the pressure vessel 1 changes the object of control from the flow regulating valve 15A to the turbine control valve 14A. The output signal of the level meter 24 is sent to the integrator 43 via the disconnecting ON/OFF controller 41, switch 41 and proportional calculator 42. After time t3, the T-RFP 10A is controlled in accordance with the output signal DM of the integrator 43. The output signal DM is sent via the electric-pressure converter 44, and is effective to reduce the opening of the flow regulating valve 15A. The reactor supply flow $W_{D3}$ produced by the M-RFP 10A decreases in response to the decrease in the output signal DM. On the other hand, the recirculation flow $W_{R1}$ also decreases, causing the reactor supply flow $W_{D1}$ to increase by the amount of that reduction. The recirculation flow $W_{R1}$ reaches zero at time t4 when the recirculation valve 17A is closed completely. At time t4, the pumped flow $W_{S1}$ through the T-RFP 8A turns directly to the reactor supply flow $W_{D1}$. The output signal DF would rise so as to compensate the reduction of the reactor supply flow $W_{D3}$, however, the rise is relatively small owing to the reduction in the recirculation flow $W_{R1}$. The rising rate of the output signal DF will gain after time t4.

At time t4, the switching control mode (I) is changed to the switching control mode (II). For a certain while after time t4, the feed-water flow $W_F$ (i.e. $W_{D1}+W_{D3}$) conducted into the pressure vessel 1 is equal to the total pumped flow $W_T$. When the reactor supply flow $W_{D3}$ through the M-RFP 10A falls below the predetermined amount (at time t5), the recirculation valve 17C is opened so as to prevent the overheating of the M-RFP 10A. The opening of the recirculation valve 17C is regulated by the recirculation flow controller 66 which receives the output signal of the flow meter 29A provided on the branch pipe 21C. The output signal of the flow meter 29A is sent via the signal converter 67, adder 73 and PI controller 68 to the function generator 69. The adder 73 produces the difference between the output signal from the signal converter 67 and the flow setup value on the flow setting device 74. The opening of the recirculation valve 17C is controlled in accordance with the output signal of the function generator 69A. Thus, when the reactor supply flow $W_{D3}$ decreases, the recirculation flow controller 66 operates on the recirculation valve 17C to gain the opening. Consequently, the feed-water discharged from the M-RFP 10A is partly fed back through the recirculation pipe 22C to the condenser 4. By this control, the feed-water flow through the recirculation pipe 22C increases even though the reduction in the reactor supply flow $W_{D3}$, and the pumped flow $W_{S3}$ through the M-RFP 10A is maintained constant. At time t6, the output signal DM becomes zero and the flow regulating valve 15A is closed completely, with the reactor supply flow $W_{D1}$ through the T-RFP 8A being at its rated capacity. At this point, switching of the feed-water pumps completes. The total pumped flow $W_T$ is now $W_{D1}$ plus $W_{S3}$, which is larger than $W_F$. At time t7, the M-RFP 10A is halted and the pumped flow $W_{S3}$ becomes zero.

The branch pipes 21C and 21D are provided with check valves 16C and 16D, respectively. The branch pipe 21D is further provided with a flow meter 29B, whose output signal is delivered to the recirculation flow controller (not shown) which controls the recirculation valve (not shown) provided on the recirculation pipe 22D. The above-mentioned controller has the same arrangement as that of the recirculation flow controller 66.

After the M-RFP 10A has been halted, the T-RFP 8B is activated. The T-RFP 8B is controlled by the T-RFP control unit (provided within the feed-water control unit 35) which shares the feed-water controller 37 and the signal converters 38 and 39 with the T-RFP control unit 47, with remaining arrangement being identical to that of the control unit 47. The following describes the starting operation for the T-RFP 8B referring to the arrangement of the T-RFP control unit 47 shown in FIG. 2. The switches in the control unit for controlling the T-RFP 8A keep the states of connection unchanged since the M-RFP 10A has been halted. The turbine speed controller 48 is operated manually and the turbine control valve 14B is opened. Then, the T-RFP 10B is activated by the extraction steam from the turbine 3. Since the switch 65 selects contact b, the recirculation valve 17B is opened. The feed-water discharged from the T-RFP 10B is fed back through the recirculation pipe 22B to the condenser 4. When the rotation speed of the T-RFP 10B has reached 40–50% of the rated speed, pressure equalization control is carried out. The switches 61 and 65 are turned to select contact b. The integrator 53 issues the speed demand signal DT in accordance with the output signal from the pressure sensor 32B. The turbine speed controller 37 causes an increase in the turbine control valve 14B. After a while, the discharge pressure of the T-RFP 8B becomes equal to that of the T-RFP 8A. The opening of the recirculation valve 17B Cis also increased in response to the output signal from the function generator 51. When the discharge pressures of both T-RFP's coincide with each other, the switch 61 is turned to select contact c while the switch 65 selects contact b. The opening of the turbine control valve 14B is controlled by the turbine speed controller 48 in accordance with the output signal DM of the PI controller 50. Thus, the pumped flow through the T-RFP 8B is maintained constant. The opening of the recirculation valve 17B is reduced in response to the output signal of the starting and parallel connecting ON/OFF controller 56. Therefore, the reactor supply flow $W_{D2}$ through the T-RFP 8B increases gradually. Oppositely, the output signal DF of the feed-water controller 37 falls, resulting in a reduction in the reactor supply flow $W_{D1}$ through the T-RFP 8A. Nevertheless, the feedwater flow $W_f$, which is the sum of $W_{D1}$ and $W_{D2}$, equals the flow before $W_{D2}$ has increased. The total pumped flow $W_T$ (i.e. $W_{D1}+W_{S2}$) is larger than $W_F$. At a time when the output signal DF coincides with the speed demand signal DT, the switch 61 is turned to select contact a, and then the T-RFP 8B is involved in the automatic control on the basis of the output signal from the feed-water controller 37 as in the case of the T-RFP 8A. At the time of transition in the contacts of the switch 61, the reactor supply flows $W_{D1}$ and $W_{D2}$ through the T-RFP's 8A and 8B coincide with each other. After a while upon selection of contact a, the recirculation valve 17B is closed completely.

Throughout the operations for switching from the M-RFP 10A to T-RFP 8A and starting the T-RFP 8B, the feed-water flow $W_F$ is maintained constant. Accordingly, the water level in the pressure vessel 1 is also maintained constant during the switching operations for the feed-water pumps, and this is carried out by controlling the pumped flow through the T-RFP's 8A and 8B to be constant and regulating the recirculation flow through the recirculation pipes 22A and 22B. Since the opening of the recirculation valves 17A and 17B is controlled directly by the output signal of the level meter 24, a high response regulation for the recirculation flow is achieved. Accordingly, the rise of the water level in the pressure vessel 1 during the switching operation of the pumps can be suppressed instantaneously. The arrangement of the feed-water control unit 35 is simple. Switching of the feed-water pumps is controlled automatically, with the minimum flow for the T-RFP's and M-RFP's being reserved during the switching.

As described above, after the reactor supply flows $W_{D1}$ an $W_{D2}$ through the T-RFP's 8A and 8B have been equalized and the recirculation valve 17B has been closed completely, the rotational speed of the T-RFP's 8A and 8B will increase in response to an increase in the power output of the boiling water nuclear reactor and the feed-water flow $W_F$ will also increase to meet the requirement for the power output.

Figure 5:
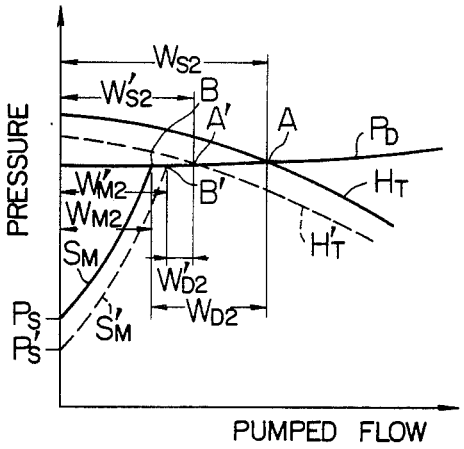
FIG. 5 is a graphical representation showing the discharge flow vs. the discharge pressure characteristics of the T-RFP.

The following will describe the reason why the pumped flow through the T-RFP needs to be controlled at a constant amount as mentioned above. During the switching process for the feed-water pumps, the suction pressure $P_S$ of the feed-water pump varies due to a variation of the total pumped flow $W_T$ as shown in FIG. 4. The effect of the varying suction pressure $P_S$ on the amount of pump flow is shown in FIG. 5, where the discharge pressure of the T-RFP is plotted against the pump flow. An assumption is made that the recirculation valve has opened and the present state is located at the intersection B of the system curve $S_M$ for the recirculation valve and the discharge pressure curve $P_D$ for the pump, causing a recirculation flow $W_{M2}$. It is also assumed that the discharge flow $W_{D2}$ of the pump is located at the intersection A of the pump head curve $H_T$ and the discharge header pressure curve $P_D$, causing a discharge flow of $W_{D2}$. If the suction pressure of the feed-water pump varies from $P_S$ to $P_S'$, the pump head curve $H_T$ and the recirculation system curve $S_M$ move downward by the distance from $P_S$ to $P_S'$ to new curves $H_T'$ and $S_M'$ and the intersections A and B move to new points A' and B', with the discharge header pressure $P_D$ of the pump being virtually unchanged. Consequently, the recirculation flow increases slightly from $W_{M2}$ to $W_{M2}'$, whereas the discharge flow of the pump decreases significantly from $W_{D2}$ to $W_{D2}'$. The pumped flow also decreases from $W_{S2}$ to $W_{S2}'$. This concludes that it is impossible to maintain the pumped flow constant merely by oeprating the turbine at a constant speed, but it is necessary to control the pumped flow at a constant amount in the switching control mode (I).

Figure 6:
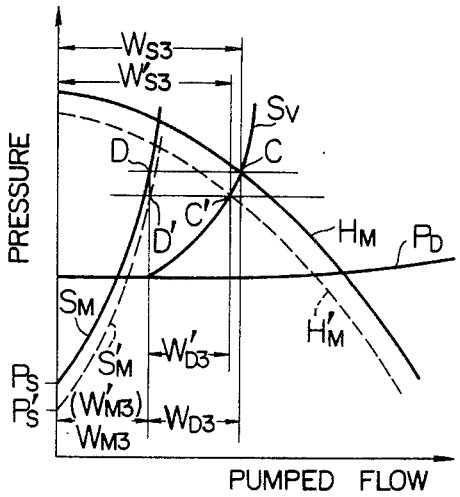
FIG. 6 is a graphical representation showing the discharge flow vs. the discharge pressure characteristics of the M-RFP.

FIG. 6 is a graphical representation showing the discharge pressure of the M-RFP plotted against the pumped flow. The discharge pressure of the M-RFP is located at intersection C of the pump head curve $H_M$ and the system curve $S_V$ for the feed-water regulating valve specific to the M-RFP. The recirculation flow $W_{M3}$, discharge flow of the pump $W_{D3}$ and the sum of these flows, i.e. the pumped flow, $W_{D3}'$ are obtained at point D which is the intersection of the system curve $S_M$ for the recirculation valve and the locus of the point C when moved in parallel to the abscissa. With the suction pressure of the pump varying from $P_S$ to $P_S'$, the intersection C will move to C' and the D to D' as in the case of the T-RFP. However, $W_{M3}$ is approximately equal to $W_{M3}'$, and the variation of $W_{D3}$ and $W_{S3}$ which will become $W_{D3}'$ and $W_{S3}'$, respectively, is very small. Accordingly, constant flow control for the feed-water pump can be carried out sufficiently solely by operating the recirculation valve 23' through the switch 15a' as shown in FIG. 2.

Figure 3:
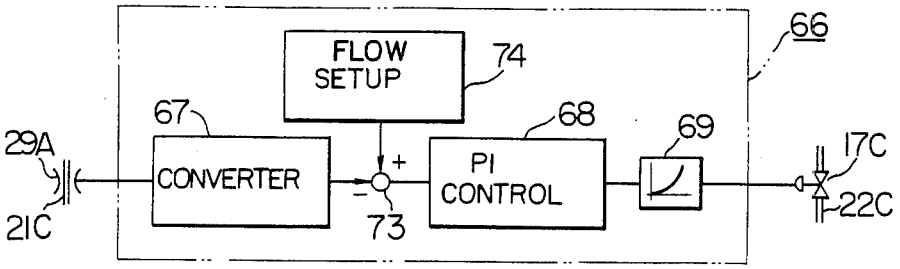
FIG. 3, is a detailed systematic diagram of the recirculation flow controller shown in FIG. 1.
Figure 7:
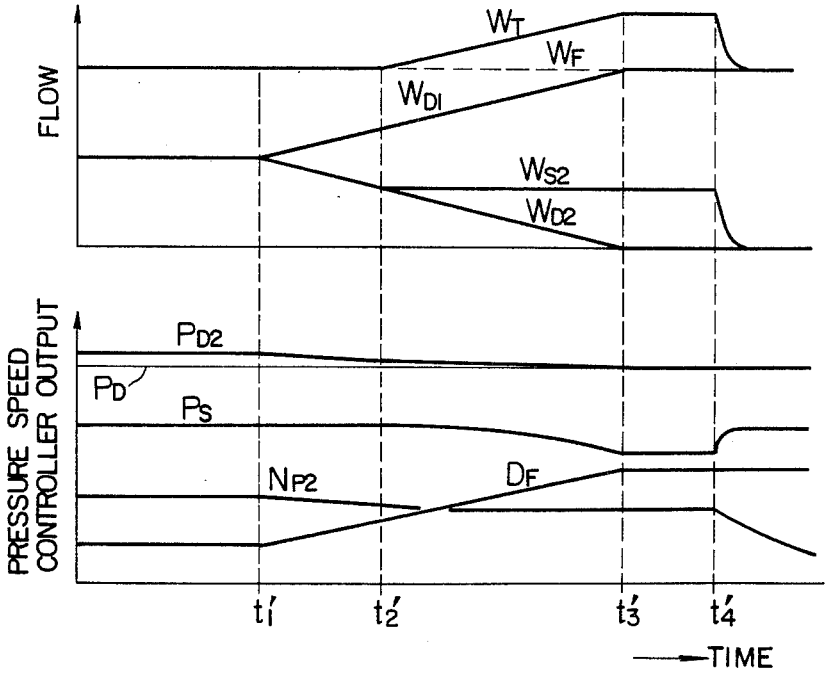
FIG. 7 is an explanatory diagram showing the control characteristics of the T-RFP during the disconnecting operation.

The foregoing operating procedures of the embodiment shown in FIGS. 1, 2 and 3 are reversed for halting the operation of the boiling water nuclear reactor. The following will describe the operation for halting the T-RFP's, exemplifying the T-RFP 8B, with reference to FIG. 7. The rotational speed of the T-RFP's 8A and 8B is lowered by the feed-water controller 37 and turbine speed controller 48 in response to a fall in the power output of the reactor. When the output signal DF of the feed-water controller 37 and the speed demand signal DT from the PI controller 50 coincide with each other (at time t1'), the switches 63 and 64 are turned to select contact a and the switches 61, 62 and 65 are turned to select contact b. In this case, the T-RFP 8B which is to be disconnected reduces the reactor supply flow $W_{D2}$ actively, that will cause a fall in the water level in the pressure vessel. Therefore, the disconnecting ON/OFF controller 57 checks the fall of the reactor water level basing on the output signal of the level meter 24 and controls the turbine control valve 14B. This is carried out by sending the output signal of the disconnecting ON/OFF controller 57 to the turbine speed controller 48 via the proportional calculator 55. At time t2', the flow through the T-RFP 8B reaches the minimum flow $W_{S2}$, then control is transferred to the switching control mode (I) by turning the switch 61 to select contact c and the switch 64 to contact b. Consequently, constant flow control for the T-RFP 8B is carried out by the turbine speed controller 48 and the opening of the recirculation valve 17B is reduced by the disconnecting ON/OFF controller 57. At time t3', the switching operation completes and the T-RFP 8B halts at time t4'. The reactor supply flow $W_{D1}$ through the T-RFP 8A increases in proportion to the fall of the supply flow $W_{D2}$ through the T-RFP 8B. The feed-water flow $W_F$ becomes equal to the reactor supply flow $W_{D1}$ when the T-RFP 8B has halted. During the operation, the feed-water flow $W_F$ is maintained constant and the water level in the reactor also keeps a constant level.

The present invention can be applied not only to the boiling water nuclear reactor as described above, but also to the steam generating boiler in the thermal power plant and the steam generator in the pressurized water nuclear reactor.

The present invention can suppress the variation of water level in the steam generator when the feed-water pumps are switched.

I claim:

1. A feed-water control system for a steam generating plant having a first feed-water pump which is disposed between a condenser and a steam generator and driven by a first driving device for supplying feed-water to the steam generator, a second feed-water pump driven by a second driving device different from that of the first driving device for supplying feed water to the steam generator, a first recirculation pipe by which a part of the feed-water discharged by the first feed-water pump bypasses the steam generator to feed back to the condenser, a second recirculation pipe by which a part of the feed-water discharged by the second feed-water pump bypsses the steam generator to feed back to the condenser, first detecting means for detecting feed-water flow supplied to the steam generator, second detecting means for detecting water level of the steam generator, third detecting means for detecting steam flow exhaust by the steam generator, first control means for controlling the feed-water flow supplied to the steam generator in accordance with output signals of the first, second and third detecting means so as to maintain the water level of the steam generator at a predetermined level, second control means for switching the feed-water supplied to the steam generator from the first feed-water pump to the second feed-water pump, third control means for maintaining the feed-water flow passing tnrough the second feed-water pump constant when the second feed-water pump is switched to supply feed-water to the steam generator under the control of the feed-water of thee first feed-water pump by the first control means, and fourth control means for reducing the feed-water passing through the second recirculation pipe while the feed-water flow passing through the second feed-water pump is maintained constant.

2. A method of feed-water control for a steam generating plant comprising the steps of measuring feed-water flow supplied to a steam generator from a condenser, water level in the steam generator, and steam flow exhausted from the steam generator; controlling feed-water flow discharged by a first feed-water pump which is disposed between the steam generator and the condenser and driven by a first driving device for supplying the feed-water to the steam generator on the basis of measured values of the feed-water flow, the water level in the steam generator and the steam flow so as to maintain the water level in the steam generator at a predetermined level; switching the first feed-water pump to a second feed-water pump which is disposed between the steam generator and the condenser and driven by a second driving device different from that of the first driving devices so as to supply feed-water to the steam generator via the second feed-water pump; and during the switching operation from the first to the second feed-water pump, reducing the feed-water which is discharged by the second feed-water pump and bypasses the steam generator to fed back to the condenser while maintaining feed-water passing through the second feed-water pump constant under the control of the feed-water flow supplied to the steam generator and discharged by the first feed-water pump according to the measured values so as to increase the feed-water discharged by the second feed-water and supplied to the steam generator.

3. A method of feed-water control for a steam generating plant according to claim 2, wherein during the switching operation, when the feed-water flow supplied to the steam generator by the second feed-water pump reaches a predetermined level, control of the feed-water supplied to the steam generator by the first feed-water pump according to the measured values is stopped and control the feed-water flow discharged by the second feed-water pump in accordance with the measured values is initiated, and increasing the feed-water flow discharged by the first feed-water pump and bypassing the steam generator to be fed back to the condenser while maintaining the feed-water flow passing through the first feed-water pump constant so as to reduce the feed-water flow discharged by the first feed-water pump and supplied to the steam generator.

4. A method of feed-water control for a steam generating plant according to claim 2, further comprising the step of measuring the rotational speed of the second feed-water pump, and maintaining a constant feed-water flow through the second feed-water pump in accordance with the measured value of the rotational speed.

5. A method of feed-water control for a steam generating plant according to claim 2, further comprising the steps of measuring the discharge pressure of the first feed-water pump and the discharge pressure of the second feed water pump, and wherein the step of switching from the first feed-water pump to the second feed-water pump is effected after the measured value of the discharge pressure of the second feed-water pump becomes equal to the measured value of the discharge pressure of the first feed-water pump.

6. A method of feed-water control for a steam generating plant according to claim 5, wherein the feed-water which is discharged by one of the first and second feed-water pumps and bypasses the steam generator to be fed back to the condenser is controlled in accordance with the measured value of the water level in the steam generator.

7. A method of feed-water control for a steam generating plant according to claim 2, wherein the feed-water which is discharged by one of the first and second feed-water pumps and bypasses the steam generator to be fed back to the condenser is controlled in accordance with the measured value of the water level in the steam generator.

8. A method of feed-water control for a steam generating plant according to claim 2, wherein the amount of feed-water supplied to said steam generator by said first feed-water pump is controlled on the basis of a water level in said steam generator, an amount of a steam flow exhausted from said steam generator and an amount of a feed-water flow introduced to said steam generator, and said control for maintaining a constant feed-water flow through said second feed-water pump is carried out on the basis of the rotational speed of said second feed-water pump.

9. A method of feed-water control for a steam generating plant according to claim 2 or 8, wherein said switching from said first feed-water pump to said second feed-water pump is carried out after a discharge pressure of said second feed-water pump has become equal to a discharge pressure of said first feed-water pump.

10. A method of feed-water control, for a steam generating plant according to claim 9, wherein said control for the recirculation flow is carried out on the basis of the water level in said steam generator.

11. A method of feed-water control for a steam generating plant according to claim 9, wherein said control for the recirculation flow is carried out on the basis of the rotational speed of said second feed-water pump while control for equalizing the discharge pressure of said second feed-water pump to the discharge pressure of said first feed-water pump is carried out.

12. A method of feed-water control for a steam generating plant according to claim 2 or 8, wherein said control for the recirculation flow is carried out on the basis of the water level in said steam generator.

* * * * *